United States Patent [19]

Beede

[11] 4,220,023

[45] Sep. 2, 1980

[54] COMBINATION LOCK

[76] Inventor: Jefts G. Beede, P.O. Box T, Fayville, Mass. 01745

[21] Appl. No.: 947,495

[22] Filed: Oct. 2, 1978

[51] Int. Cl.[3] ..... E05B 37/02

[52] U.S. Cl. ..... 70/312; 70/315

[58] Field of Search ..... 70/288, 304, 308, 309, 70/311, 312, 315, 316, 317, 318

[56] References Cited

FOREIGN PATENT DOCUMENTS 781829 3/1935 France ..... 70/288

791559 9/1935 France ..... 70/288

1120048 4/1956 France ..... 70/315

*Primary Examiner*—Robert L. Wolfe

*Attorney, Agent, or Firm*—Charles R. Fay

[57] ABSTRACT

A combination lock which may be set to a desired combination at one side of the door on which the lock is mounted and which may be unlocked from the outside of the door by one knowing the combination. The mechanism includes a plurality of barrels each having two thimbles, one at the inside and one at the outside of the door, the outside thimbles each having a connection with its barrel to turn the same according to a preset condition accomplished by the inside thimble.

5 Claims, 3 Drawing Figures

FIG. 2
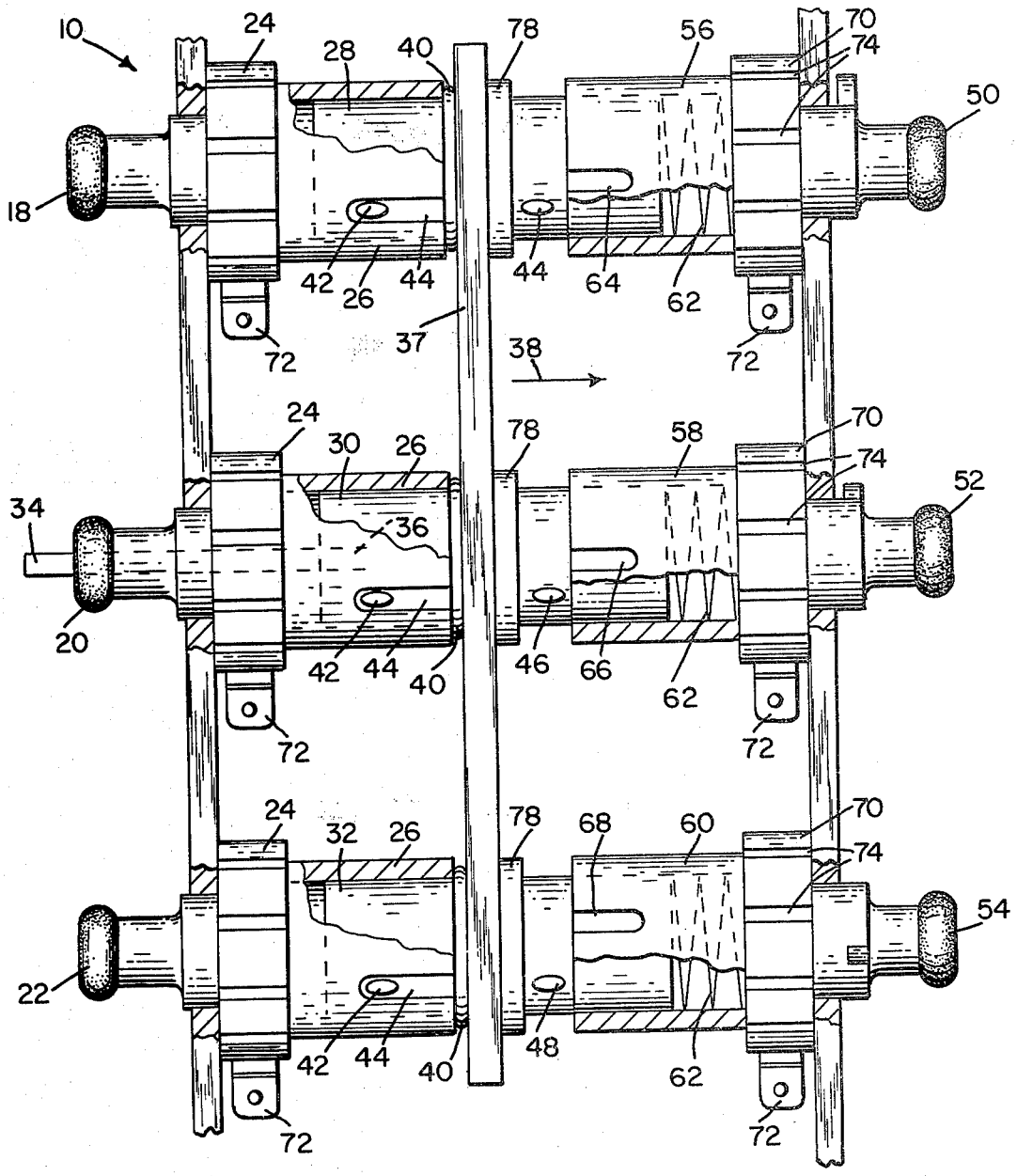
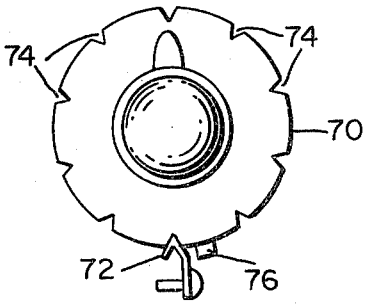
FIG. 3

COMBINATION LOCK

BACKGROUND OF THE INVENTION

The provision of safety locks, pick-proof locks, etc., as well as conventional and well known combination locks, all to improve the security of a house, hotel room, office, etc., are well known. The present invention provides an interchangeable combination lock which is easily set through many different selective combinations at the inside of the door before the user leaves the secured premises.

Knowing the combination to which he has set the lock from the inside, he then can turn the combination of the thimbles at the outside of the door to unlock the same.

SUMMARY OF THE INVENTION

A bar is provided which must be moved rectilinearly to move a cam to withdraw a locking bolt. This bar is held in position against such motion by means of small protuberances arranged on a series of barrels, three being a practical number. At the inside of the lock, each barrel is provided with a thimble which can be turned manually and is provided with a slot which can be aligned or misaligned with respect to the protuberance involved on the barrel, and when it is misaligned the bar cannot be pushed back to cam the bolt.

Each barrel is substantially the same but the operator is able to position the inside thimbles at different degrees of misalignment with respect to the respective barrel protuberances, for instance on a scale of one to ten, under control of a ratchet wheel or the like under control of the respective thimble. There is preferably a ratchet stop to indicate zero or a starting point, so that the operator of the combination can work it in the dark.

Insofar as the interior thimble is concerned, the barrel is substantially in fixed position, but at the outside of the door the lock provides another thimble which has an engagement with the barrel by which each barrel may be turned separately, remembering that there are e.g. three barrels, each with its own operating thumbpiece, or knob. The operator is, of course, the only person who knows what the combination has been set to, and he can turn the individual barrels to align the protuberances thereon with respect to the slots in the interior thimbles, whereupon a push-rod which may be appropriately arranged, with one of said outside knobs, can be used to depress its particular barrel against a barrel spring, at the same time thereby depressing the bar and all of the barrels, thereby operating the cam to withdraw the bolt.

It is preferred but not necessary that the regular lock parts which are conventional and are not further described herein may include provision for over-riding the combination lock by means of e.g. a master key should this be desired, so that the entire lock may be operated by a master key or "change" key, or it may be operated only through the use of the combination. It is to be especially noted that the combination is quickly and easily changed any time that the operator wishes to leave the premises under securement. A scrambling mechanism can also be incorporated, see U.S. Pat. No. 3,369,382, issued February, 1968.

It will be seen that the benefits from the use of this lock are very great in view of the fact that most motels and hotels have as many as eleven to fifteen keys per room not under their control and which have been "lost", but are available for unlocking rooms in an unauthorized way, whereas in the present case by a very simple manipulation the room, office, etc., is made practically secure insofar as the lock is concerned. A major New York City hotel has had ten thousand lost keys in a single year, but with this invention, a hotel would not have to issue so many keys.

BRIEF DESCRIPTION OF THE DRAWINGS

FIG. 2 is a view on an enlarged scale illustrating the lock mechanism per se, and FIG. 3 illustrates the rathet disc and stop used for rotating the protuberances on the various barrels involved.

PREFERRED EMBODIMENT OF THE INVENTION

Figure 1:
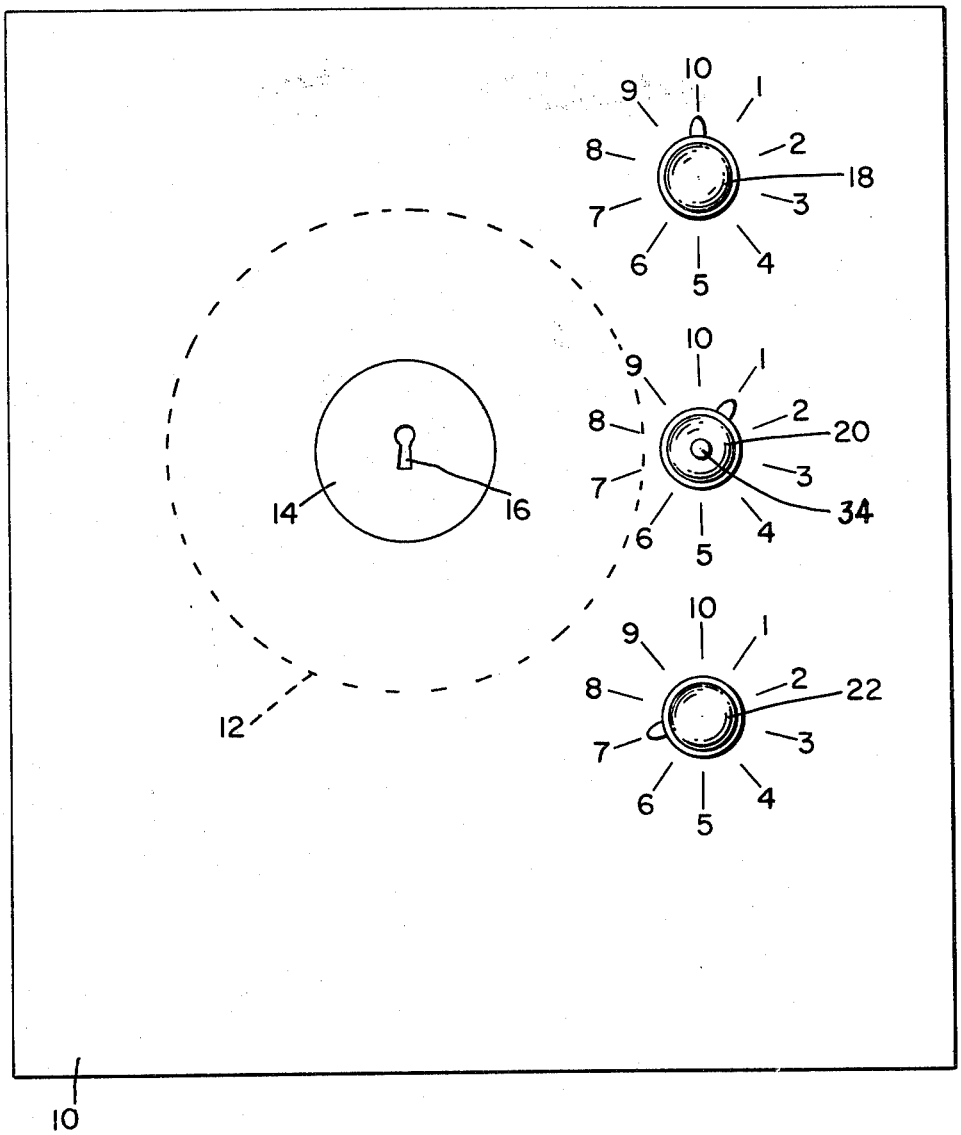
FIG. 1 is a general view in front elevation which indicates the relative position of the combination lock operating knobs relative to the regular lock mechanism, etc.

In FIG. 1 there is shown a plate 10 which may be of any size or configuration and provides a mounting for a conventional knob 12, locking mechanism or the like 14, which has a slot 16 for a key not shown, all as is conventional and well known in the art.

At one side of the plate there are provided three knobs or fingerpieces and these are indicated as at 18, 20 and 22. Each of these knobs is provided with a pointer and a surrounding indicia, e.g. markings as 0–10. Also a stop may be used to show zero, as will be described hereinafter. Each knob is mounted on a block 24, 24, 24, in turn mounting a thimble 26, 26, 26, FIG. 2. In each thimble there is located a barrel 28, 30, 32, and each thimble 26 is adapted to rotate its respective barrel.

The knob 20 is provided with a simple bore in which is mounted a push rod 34 secured as at 36 to its respective barrel 30, rod 34 being rectilinearly reciprocal under certain conditions.

Each of said barrels extends through a bar 37. This bar is suitably mounted so it cannot twist but it can move rectilinearly a short distance as indicated by arrow 38 and this is under influence of push rod 34 when conditions are such as to allow push rod 34 to move to the right. Appropriate snap rings 40, 40, 40 are utilized to surround the respective barrels and as noted above when the bar 37 is moved in the direction of the arrow 38 it actuates a cam to move a locking bolt to unlocked position but the details of this action are not shown because they are conventional.

Each barrel is provided with at the left-hand side of bar 37 with a protuberance 42 engaged in a slot 44 in each of the thimbles 26, 26, 26 so that the barrels 28, 30, and 32 are rotatable in bar 37 by means of the respective knobs 18, 20 and 22.

Each barrel is provided with a right-hand protuberance 44, 46, 48 which, of course, is rotated therewith under influence of the respective knobs 18, 20 and 22.

The knobs 18, 20 and 22 are outside the door, the view in FIG. 1 illustrating the outside of the door.

At the inside of the door there are provided similar knobs 50, 52, 54 integrally mounted with respect to the thimbles 56, 58 and 60. Each of these thimbles contains a barrel spring 62, 62, 62 and each thimble is provided with an open-ended notch or slot 64, 66, 68. These slots may be rotated through a 360° turn by means of the respective knobs 50, 52 and 54 at the same time turning a ratchet 70, FIG. 3, having an audible or touch-sensible clicker 72 riding the surface of the ratchet wheel 70, the latter having notches 74 for the purpose of alerting the operator as to the position of the thimbles 56, 58, and 60 with reference to the set position of protuberances 44, 46 and 48. That is, the thimbles 56, 58, and 60 have been turned individually by knobs 50, 52 and 54 to various degrees of misalignment at the open-ended slots or notches 64, 66 and 68 relative to protuberances 44, 46, 48. A stop 76 can be used as a zero position from which to start to work the combination, and this is particularly to use in the dark.

In the operation of the device at the inside of the secured room looking at the right-hand side of FIG. 2, knobs 50, 52 and 54 are turned to any position being held by the ratchet shown in FIG. 3 to various degrees of misalignment of the respective slots to protuberances 44, 46 and 48. Now it is seen that plate 37 cannot be moved to the right to operate the cam to operate the bolt. Collars 78 may be applied to the barrels to avoid contact of the bar and the protuberances. Upon leaving the room and closing the door, thus actuating say for instance the conventional spring latch or the like, the room is secure except from actual forcible entry. When the protuberances and slots are aligned, push rod 34 is free to be pressed to move the lock actuator to locking condition.

The bar 37 may be provided with appropriate guides to prevent cocking or sticking, but with the exception of the mechanisms above-described, the lock parts per se may be as desired or conventional.

I claim:

1. A combination lock comprising a member movable to operate the lock and means for preventing such motion, said means comprising two sets of a plurality of settable digitally actuated knobs, there being corresponding sets of knobs at each side of the lock, the knobs of a first set being set in a selected series at one side of the lock, and a corresponding second set of knobs at the other side of the lock requiring corresponding settings in order to release said member to allow motion thereof, means actuatable only upon corresponding setting of the knobs of both sets to move said member to actuate the lock, said last named means including a barrel for each of a pair of opposite corresponding knobs, interengaging means between each knob of the first set and the barrel, and means including the barrels for selectively misaligning said interengaging means, said barrels being connected to said member to operate the lock, the knobs of the second set at the other side of the lock being actuatable to turn the barrel to align said interengaging means, a thimble for each knob, the knobs of the first set at the one side of the lock each being attached with respect to a thimble thereby to turn the thimble by means of the individual knobs, and a protuberance on each barrel, said thimbles each having a slot which when aligned with its respective protuberance allows the motion of the member but when misaligned prevents the same.

2. The lock of claim 1 wherein the knobs of the second se at the said other side of the lock are attached to thimbles, said thimbles being capable of turning a respective barrel to align the respective protuberance in the respective slot.

3. The lock of claim 2 wherein there are at least two barrels independent of each other, each barrel having knobs at either side of the lock with respect thereto.

4. The lock of claim 3 including barrel springs normally and resiliently holding the respective barrels in a position away from the first-named set of knobs and towards the second-named set of knobs.

5. The lock of claim 4 wherein one of the second-named set of knobs is provided with a plunger engaged with the member for operating the lock so that when the protuberances on all the barrels have been aligned with the respective slots in the thimbles of the first-named set of knobs, the plunger is free to be manipulated to move the lock actuator member to lock actuating condition but not otherwise.

* * * * *